US008146324B1

(12) United States Patent
Kelly et al.

(10) Patent No.: US 8,146,324 B1
(45) Date of Patent: Apr. 3, 2012

(54) NON-INVASIVE METHODS OF SECURING AN INSTALLED METAL ROOF

(76) Inventors: Matthew M Kelly, Cataño, PR (US); Peter Hambly, Carolina, PR (US)

( * ) Notice: Subject to any disclaimer, the term of this patent is extended or adjusted under 35 U.S.C. 154(b) by 67 days.

(21) Appl. No.: 12/386,676

(22) Filed: Apr. 20, 2009

Related U.S. Application Data

(63) Continuation-in-part of application No. 11/527,055, filed on Sep. 26, 2006, now Pat. No. 7,520,103.

(51) Int. Cl.
*E04B 1/61* (2006.01)

(52) U.S. Cl. ..... 52/748.1; 52/745.21; 52/749.12; 52/410; 52/745.06; 52/127.7; 52/478; 52/518

(58) Field of Classification Search ..... 52/745.13, 52/127.7, 127.8, 409, 745.12, 749.12, 410, 52/748.1, 748.11, 747.1, 745.06, 478, 518
See application file for complete search history.

(56) References Cited

U.S. PATENT DOCUMENTS

| | | | | | |
|---|---|---|---|---|---|
| 3,909,998 | A * | 10/1975 | Simpson et al. | 52/223.6 |
| 4,114,335 | A * | 9/1978 | Carroll | 52/336 |
| 4,403,980 | A * | 9/1983 | Simpson et al. | 52/309.11 |
| 4,450,663 | A * | 5/1984 | Watkins | 52/309.4 |
| 4,525,967 | A * | 7/1985 | Simpson | 52/404.2 |
| 4,736,561 | A * | 4/1988 | Lehr et al. | 52/410 |
| 5,319,908 | A * | 6/1994 | Van Erden et al. | 52/410 |
| 5,383,315 | A * | 1/1995 | Birs | 52/202 |
| 5,404,687 | A * | 4/1995 | Blake et al. | 52/600 |
| 5,406,764 | A * | 4/1995 | Van Auken et al. | 52/408 |
| 5,584,153 | A * | 12/1996 | Nunley et al. | 52/410 |
| 5,857,292 | A * | 1/1999 | Simpson | 52/22 |
| 6,256,957 | B1 * | 7/2001 | Kelly | 52/413 |
| 6,401,412 | B1 * | 6/2002 | Cooper | 52/302.1 |
| 7,735,267 | B1 * | 6/2010 | Ayers, Jr. | 52/96 |
| 7,793,479 | B2 * | 9/2010 | Kelly | 52/409 |
| 2002/0095898 | A1 * | 7/2002 | Bettencourt | 52/506.05 |
| 2002/0126131 | A1 * | 9/2002 | Davis | 345/582 |
| 2006/0144005 | A1 * | 7/2006 | Tonyan et al. | 52/653.1 |
| 2007/0193157 | A1 * | 8/2007 | Kelly | 52/309.8 |

* cited by examiner

*Primary Examiner* — Brian Glessner
*Assistant Examiner* — Joshua Ihezie
(74) *Attorney, Agent, or Firm* — Hoglund & Pamias, PSC; Roberto J. Rios

(57) ABSTRACT

A method of securing an installed metal roof deck covered with at least one layer of insulation and/or sealer. The metal roof deck is supported by a plurality of parallel metal beams. Access holes are drilled through the insulation and/or sealer at opposite ends of a beam. Self-drilling, self-tapping screws are positioned through the pilot holes and turned through the metal roof and beams. A guide is used to drill additional access holes aligned with valleys in the metal roof deck. Self-drilling, self-tapping screws are drilled through the metal roof and beams. When no access is available for visual inspection of the deck and or the beams, the same locating process is followed in a "Blindly", or by "Feel" way.

19 Claims, 6 Drawing Sheets

NON-INVASIVE METHODS OF SECURING AN INSTALLED METAL ROOF

CROSS-REFERENCE TO RELATED APPLICATIONS

This application is a continuation-in-part of U.S. patent application Ser. No. 11/527,055, filed on Sep. 26, 2006, now U.S. Pat. No. 7,520,103. The entirety of this application is incorporated herein by reference.

FIELD OF THE INVENTION

The invention relates generally to methods of securing an installed metal roof. More specifically, the invention relates to methods for fastening installed metal panels to structural roof support beams, without detrimentally effecting the existing insulation and roof system.

BACKGROUND

Rectangular metal panels are widely used to form roofs on industrial buildings. In typical installations, walls or columns are constructed, that support horizontal metal beams. These are positioned parallel to one another and at regular intervals. The rectangular metal panels are then placed on top of the metal beams. They are typically arranged on a grid so that the sides and ends of adjacent panels overlap. After covering the roof with metal panels, additional layers of material are added to seal and/or insulate the roof. These can include one or more layers of sand, gravel, insulation, foam, concrete, silicon paint, tar, perlite, gypsums and/or other materials.

In typical installations, the metal panels have been insufficiently fastened or attached to the metal beams. This leaves the roof vulnerable to high winds and hurricanes, which can tear the metal panels away and expose the interior of the structure.

Accordingly, methods have been applied to further attach existing metal panels to the metal beams. Metal clips are fastened to the deck from underneath, that lap onto the edge of the beam adding additional fastening. Where the beams are flanged a fastener with an oversized washer is installed from underneath grabbing the flange and the deck. Also, the metal panels may be fastened to the metal beams by drilling a hole through the metal beam and into the metal panel. The metal roof is corrugated so that it has parallel peaks and valleys at regular intervals. Fastening is installed on a grid pattern at each place where a valley of the metal roof touches a beam. A screw (or a nut and bolt) is then used to better attach the metal panel. While this method is effective, it suffers from a couple significant disadvantages. First, it requires scaffolding, ladders or other apparatus to permit a construction worker to install the fasteners. Where the building is used to shelter an industrial operation, such as a factory, that runs around the clock, it may be difficult to install these fasteners without interfering with the normal operations within the building. Second, drilling into the metal panels generates debris. Also the pull out values are low for this use of the fasteners, so an increased number of units must be installed. Again, depending upon the particular application, if the building is used to shelter a clean environment, such as a pharmaceutical plant, this may interfere with normal operations within the building. Another method is to cut a 6 or 8-inch strip of the existing roof system from above directly over the beam, exposing the deck, and installing additional fastening. The dilemma of this installation is that it disrupts the integrity of the roof system weakening the complete unit, causing leaks.

SUMMARY OF THE INVENTION

It is an object of the present invention to provide a method of attaching a corrugated metal roof to metal supporting beams.

According to one aspect of the invention, an installed metal roof deck is formed by a plurality of rectangular, overlapping, corrugated panels covered with at least one layer of insulation or sealer and supported from below by a plurality of parallel beams. The installed metal roof deck is secured by identifying a first location for a first fastener. The first location occurs where a first beam meets a first valley in the corrugated panels. A first access hole is drilled through the at least one layer of insulation or sealer at the first location. The first access hole does not extend through the corrugated panels. A first self-tapping screw is positioned through the first access hole. The first self-tapping screw is driven through the corrugated panels and into the first beam. A second location for a second fastener is identified. The second location occurs where the first beam meets a second valley in the corrugated panels at a predetermined distance from the first location. A second access hole is drilled through the at least one layer of insulation or sealer at the second location. The second access hole does not extend through the corrugated panels. A second self-tapping screw is positioned through the second access hole and driven through the corrugated panels and into the first beam. A template that extends from the first self-tapping screw to the second self-tapping screw is positioned. The template includes regular marks to identify intersections of the valleys in the corrugated panels and the first beam. Additional access holes are drilled through the at least one layer of insulation or sealer at locations aligned with the regular marks on the template. The additional pilot holes do not extend through the corrugated panels. Additional self-tapping screws are positioned through each of the additional access holes and driven through the corrugated panels and into the first beam.

According to further aspects of the invention, the first location for the first fastener is identified by viewing the metal roof deck from a perspective below the plurality of metal beams.

According to another aspect of the invention, when no access is available for visual inspection of the deck and or the beams, the same locating process is followed in a "Blindly", or by "Feel" way.

According to yet another aspect of the invention, the regular marks on the template are spaced at an interval equal to a distance between valleys in the corrugated panels. The additional self-tapping screws are positioned through each of the additional access holes comprises by placing a head of the self-tapping screws in an extended socket having a length sufficient to reach through the at least one layer of insulation or sealer, and secure fastener head at deck below. The additional self-tapping screws are driven through the corrugated panels and into the first beam using a power drill, which automatically stops before the self-tapping screws strip by releasing a clutch.

DETAILED DESCRIPTION

Figure 1:
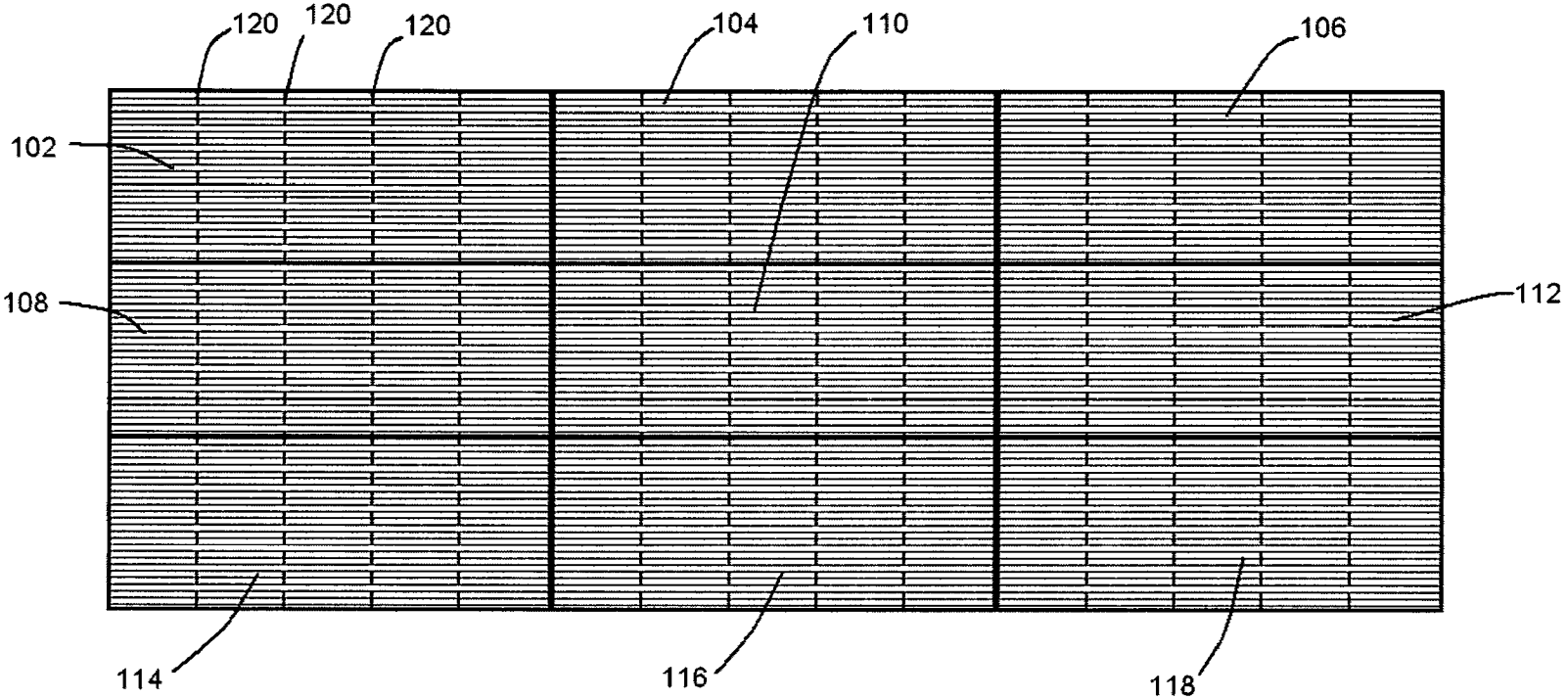
FIG. 1 is top plan view of a portion of a roof having nine rectangular metal panels.

A corrugated metal roof is secured using a plurality of self-tapping screws. The corrugated metal roof consists of a plurality of rectangular panels. These are arranged on a grid and supported below by metal beams. The metal panels are positioned so that they overlap with adjacent panels along both sides and both ends of each panel. The metal panels are covered with top layers of insulation and/or sealer. A first metal beam is found, preferably by measuring its location from below then drilling an access hole through the top layers of insulation and/or sealer. Although this may be determined through the "Blind" installation process to be discussed later. Through that hole we install the pilot fastener where the beam is expected. Either striking the beam, or by inspection making the necessary adjustments to contact the beam. The fastener is driven by an elongated socket, engages a self-tapping screw. The elongated socket is driven by a clutched-drill. The self-tapping screw is driven through the metal panel and the metal beam below until the clutch of the drill releases, which indicates that the screw is tight and secure. In the event that the clutch does not release, one of two possible problems exist. The clutch is set too tight and the screw has stripped out the hole, which can happen in thinner beams, C channel & Z Bar. In this case, the clutch must be loosened so that it will release before the screw strips out the hole. In addition, the fastener could to be changed also to a courser thread style such as self-tapping point. Preferably this adjustment is made before beginning the project. Alternatively, the screw did not hit a beam. In this case, an inspection is made from below to determine the distance and direction of the miss. Or as will be explained later, a "Walk it in" approach can be used. An aspect of the "Blind" installation, where you install a fastener approximately every +/−1½" until contacting the beam. The lack of exactly square existing joist placement makes this process a well used alternative. If the first screw was near the beam, the same access hole may be used. If the miss was substantial, another access hole can be drilled. In either case, a second screw is put into the valley of the metal panel and is positioned to hit the beam based upon the determined distance and direction of the miss. The first screw is positioned in one of the valleys located nearest to the end of the beam. Next, a second access hole is drilled. It is positioned over the same beam, but at the opposite end, or at the lesser distance required. It is not attempted to "Lay out" more than the approximate 20 to 24 foot distance typical of column to column spacing, because the joists are typically enough out-of-square that the use of the jig will not be effective. The same procedure used with the first screw is applied to the second screw. With these two in place, a straight-line guide is positioned between the first and second screw. The distance between valleys is known. Accordingly, additional screws are drilled through each valley and into the same beam. After securing each screw, the access hole through the top layers of insulation and/or sealer is filled. This may be accomplished by driving a pre-fabricated tapered rigid foam plug into the void as shown on FIG. 5, or by spraying polyurethane foam (or "poly" foam) sealer into the hole. A wide variety of such sealers are commercially available in a spray can, with a small tube for dispensing the foam. This tube is placed at an angle into the pilot hole so that the end of the tube abuts the side of the pilot hole. The foam accumulates in the hole until it is filled. An additional layer of sealer may be used to cover and further protect the access hole.

When no access is available for visual inspection of the deck and or the beams, the same locating process is followed in a "Blindly", or by "Feel" way. Under these circumstances, a linear pattern of holes is drilled initially approximately 6" apart to "Feel" the deck and more specifically the direction of the flutes (ribs). Once this is determined we shorten the distance between the holes to "Feel" the deck style (width of flute, taper of sides, and the width of the top surface of the deck). With the deck style determined, we can then begin to locate the first beam. There are some basic boundaries that are "known" under "typical construction style knowledge" for instance: beams will almost never be closer together (parallel) then 32", they should really never be further apart than 8'. So within those boundaries we will search for the beam. There are a number of other techniques we use to try to limit error initially. Sounding the roof by solidly thumping along a pattern. Alternatively, solidly bouncing the area to watch for deflection patterns, and "eyeing" the roof for slope changes that might identify the beam location. Regardless of the method used, the purpose is to get as close as possible to the beam location. The determining step is to begin a lineal pattern of fastener installation attempts ("Walking it In") that will eventually make contact with the beam. Once a first contact with the beam occurs, time is spent to install a number of fasteners (usually 6) in the beam actually trying to miss the beam by a very small margin, on both sides of the beam. This way the width of the beam can be determined if it was previously unknown. The same process is followed to look for the second beam. With the second beam we can usually determine the layout pattern, and become much more accurate locating the balance of the beams to be fastened.

Turning to FIG. 1, a portion of an existing roof is shown with any top layers of insulation and/or sealer removed. The portion of the roof 100 consists of nine metal panels 102, 104, 106, 108, 110 and 112. Ordinarily, the corrugated metal panels would not be visible, but are shown in this figure for purposes of illustration. The panels are rectangular and arranged on a grid. The right-most end of panel 102 overlaps the left-most end of panel 104 and the right-most end of panel 104 overlaps the left-most end of panel 106. The panels are positioned so that their corrugation aligns. The valleys of panel 102 (shown as horizontal lines) rest inside the valleys of panel 104. The valleys of panel 104 rest inside of the valleys of panel 106. Panels 108, 110 and 112 are arranged in the same manner as panels 102, 104 and 106. In addition, the bottom sides of panels 102, 104 and 106 overlap the top sides of panels 108, 110 and 112. Panels 114, 116 and 118 are arranged in the same manner as panels 108, 110 and 112. In addition, the bottom sides of panels 108, 110 and 112 overlap the topsides of panels 114, 116 and 118.

Figure 6:
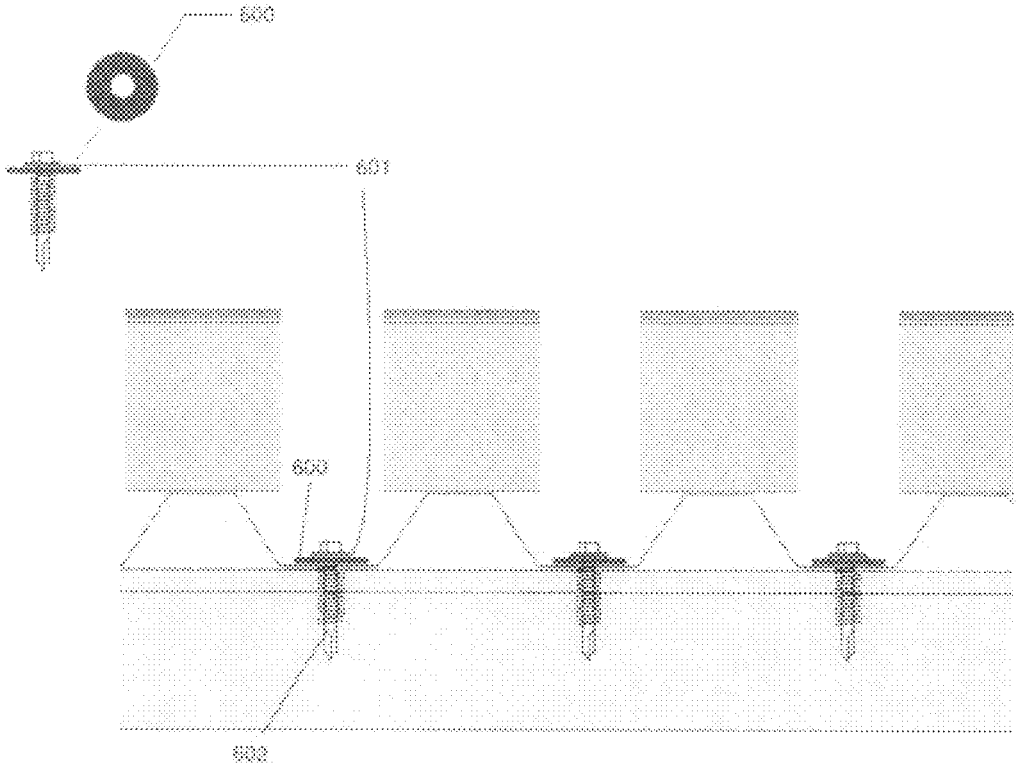
FIG. 6 is a cross-sectional view of a metal roof deck installation procedure using a surface area-increasing washer according to an aspect of the invention.

The panels are supported from below by beams 120. These are regularly spaced and run parallel to each other. The beams may be "I" beams, flanged joists, C channel, Z bar or any other commercially used beam. The fasteners are selected depending upon the type and thickness of the beams. Additionally to increase the pull over value of the fastener, a greater fastened surface area might be required. Where the typical fastener head is approximately 0.42 inched wide, the surface are can be increased by installing a washer of sufficient width. This can be accomplished in this same process by using hot glue to position and hold the washer in place while the fastener installation is accomplished as shown in FIG. 6.

Figure 2:
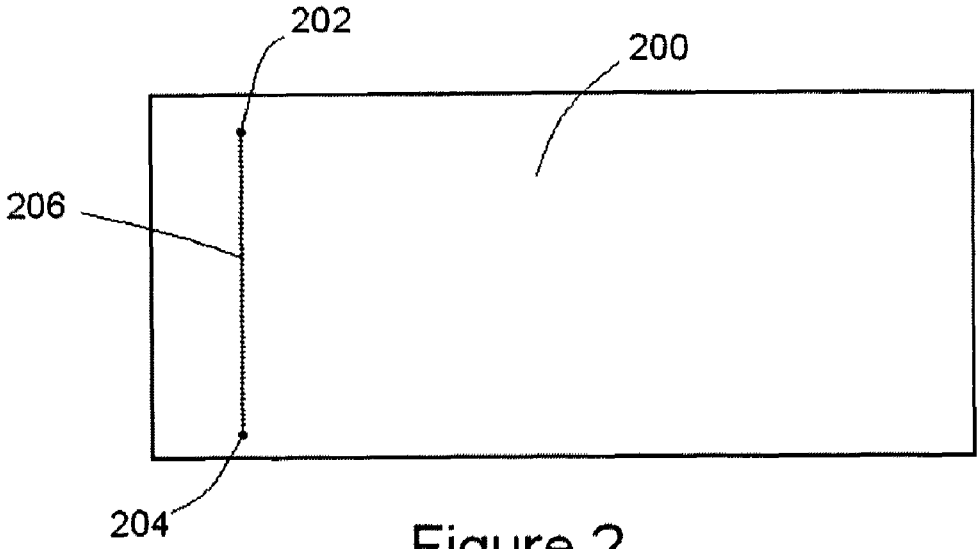
FIG. 2 is a top plan view showing one method of determining the location of the beams below the metal panels.

Turning to FIG. 2, the process of securing the metal panels of the roof deck is further described. A portion of a roof 200 is shown. It has the same construction as the roof shown in FIG. 1, but with the addition of top layers of insulation and/or sealer. These cover the peaks and valleys in the corrugated metal panels. A measurement of the location of the intersection between a first beam and valley is taken from below. Alternatively, the top layers can be removed around this location to have a complete view of the beam arrangement. This permits an accurate determination for the placement of the first screw 202. In addition, it permits the operator to adjust the drill clutch. It is set so that the clutch releases when the screw tightens against the metal panel but before the screw strips out the hole in the metal support beam. A determination is also made from below as to whether all of the support beams are the same type. If the roof has different sections, with different beam types, this process of adjusting the clutch will be repeated at each instance where a new hole is drilled in a different type of beam.

Figure 4:
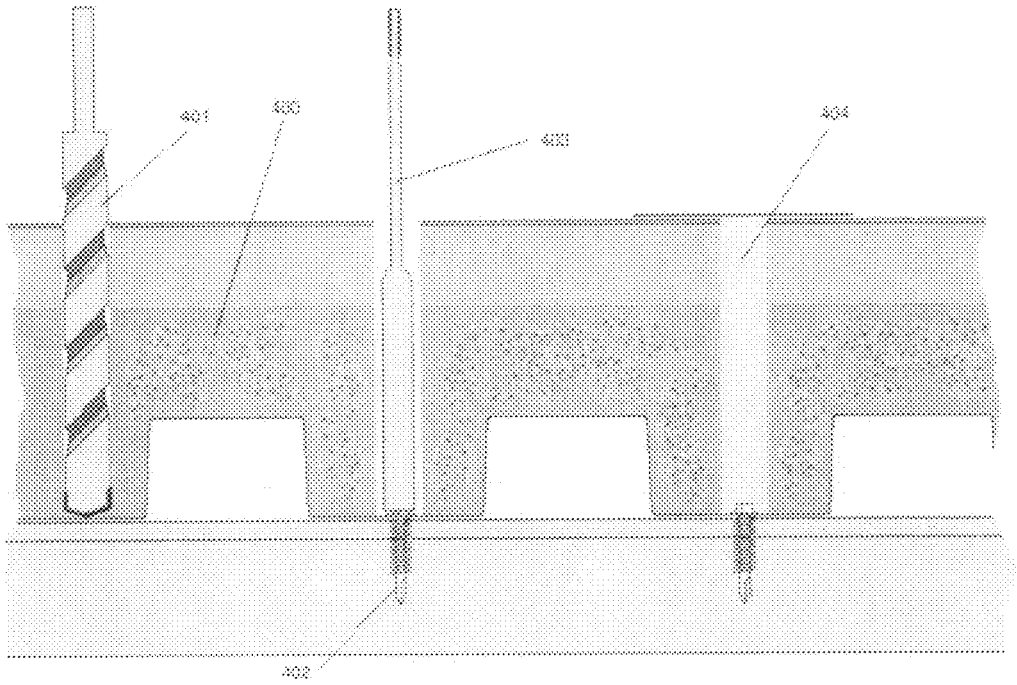
FIG. 4 is a cross-sectional view of a metal roof deck installation procedure under light cement conditions according to an aspect of the invention.

Additionally, the deck might be filled with lightweight concrete as shown in FIG. 4. This can affect several steps during installation. When working "blindly", locating the beams is much more difficult. Although the final step of confirming the beam location width and thickness is exactly the same, neither sounding, nor eyeing the deck to determine the best start locations, is effective. Also the pilot bores must be cleaned of the drilling debris prior to the installation of the fastener, to allow the head to seat satisfactorily. This can be accomplished with a specially tapered nose-piece on an industrial vacuum. Although a concrete drill bit is the best choice for all installation styles, it is particularly necessary for this style of installation. Especially where the lightweight cement is of the higher density/hardness range, the installer should take the time initially to get the feel for the cement and deck so that the number of "drill throughs" is limited.

Next, a second screw 204 is positioned based upon the position of the first screw 202 as well as from a measurement taken from below. An access hole is drilled through the top layers of insulation and/or sealer. The self-tapping screw is then drawn through the metal panel and through the metal beam until its head is tight against the metal panel. Because the clutch was adjusted with the first screw, it will release when tightened and before the self-tapping screw 204 strips the hole it drilled in the metal beam.

Figure 5:
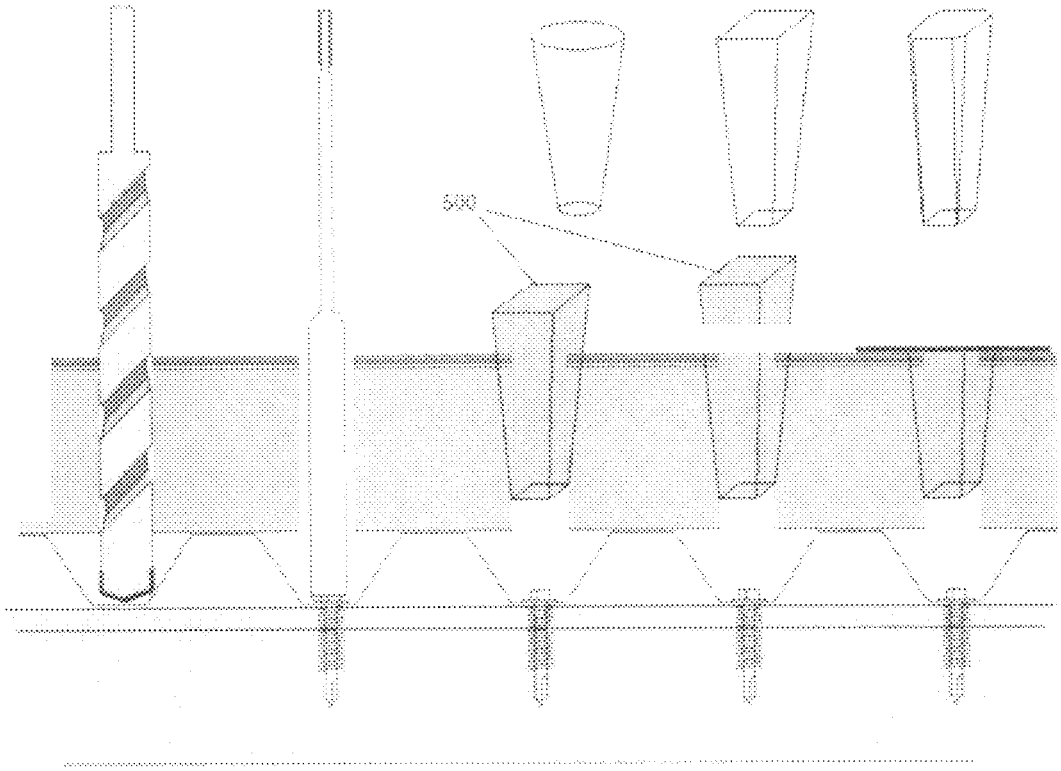
FIG. 5 is a cross-sectional view of a metal roof deck installation procedure using tapered plugs according to an aspect of the invention.

Next, a template 206 is positioned between the first screw 202 and the second screw 204. The template is preferably an aluminum metal strip but can be made of any material and could alternatively be a simple straight line drawn between the first screw 202 and second screw 204. Although the length and the marking for the valleys is the primary importance, the width can be chosen to "template"/jig the required width to "Double Stitch" (install 2 fasteners per beam width) the beam. Double Stitching is where 2 fasteners are installed at the same intersection of 1 beam and 1 valley. The template is marked at regular intervals having the same spacing as the valleys in the corrugated metal panels below. These markings are used to estimate the location for the intermediate screws. An access hole is drilled at each mark. In some installations the metal panels can be stretched and in others compressed. Accordingly, after drilling an access hole the operator must feel whether it is aligned with the center of a valley. If it is close, but not perfectly aligned, the operator may be able to adjust by positioning the screw at a slight angle. If it is further off the center of a valley, however, another access hole is drilled directly over the valley. Subsequent holes are similarly adjusted. When a row is completed, the access holes are filled by tapered plugs or injecting poly foam. This hardens. At the end of the day, a strip of roofing material is used to further seal and protect the holes. The advantages of the tapered plugs are that they are immediately ready to be sealed over as shown in FIG. 5, which is very helpful when working in difficult weather.

Next, the template 204 is moved over the adjacent beam. Because the spacing of the beams can be determined from below, it is easily positioned based upon the location of the screws 202 and 204 in the first row. The process of drilling pilot holes and fastening self-tapping screws is repeated so that a screw is drawn into the intersection between each valley and a beam.

Figure 3:
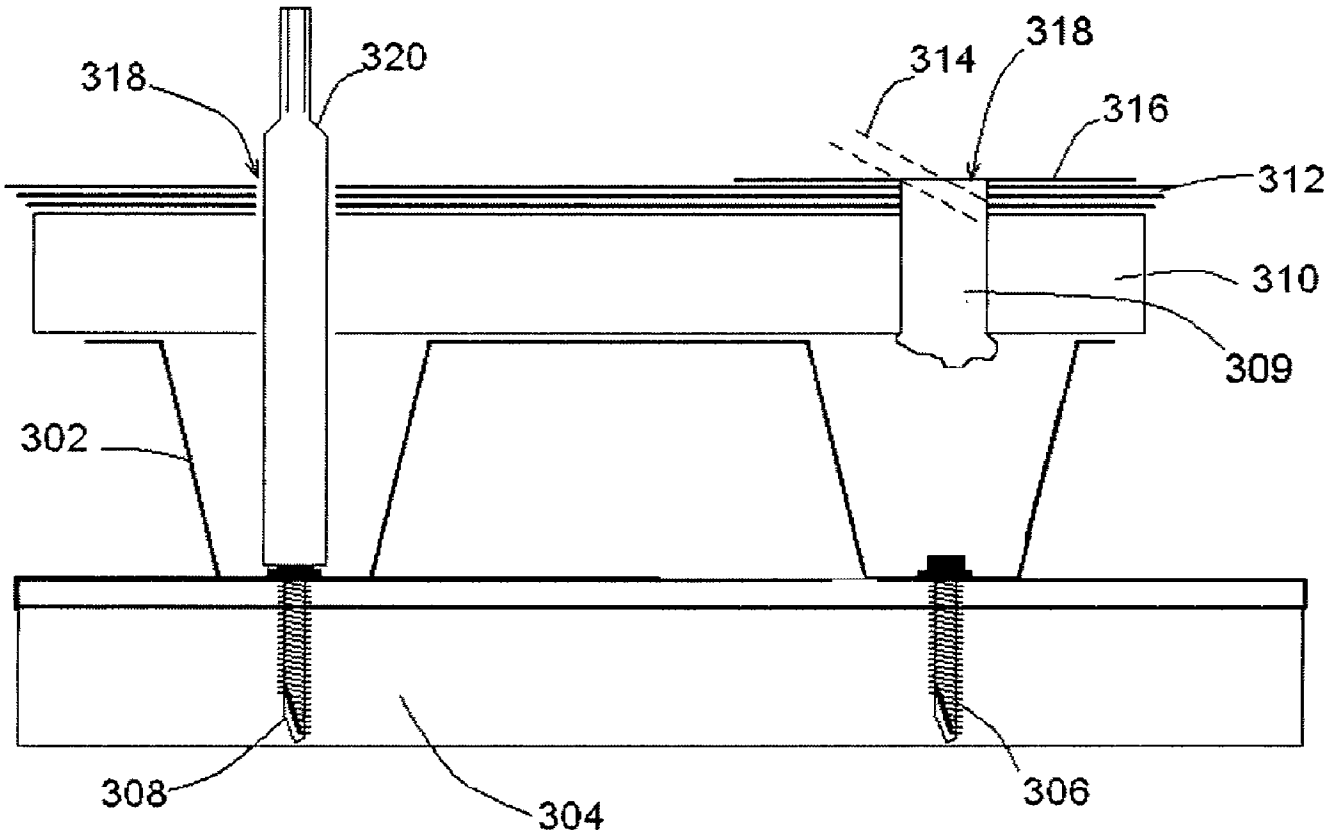
FIG. 3 is a side cross-sectional view showing the installation of self-tapping metal screws from above to secure the metal panels.

Turning to FIG. 3, a side cross sectional view shows the process of attaching a metal panel 302 to a support beam 304. As shown, the metal panel 302 has peaks and valleys. A self-tapping screw 306 is shown fully fastened in one valley. An access hole 318 was drilled through the layer of insulation 310 and layers of sealer 312. This is sealed with poly foam 309. Specifically, the tube 314 from a spray can is positioned at an angle inside the hole so that the end of the tube is against the side of the pilot hole 318. The initial position of the tube 314 is shown in phantom lines. The foam is sprayed through the tube until the hole is filled and then the tube is removed. Alternatively, a tapered plug may be used to fill the pilot hole. A further layer of sealer 316 is added over the top of the pilot hole.

Another self-tapping screw 308 is shown as its head is drawn tight against the adjacent valley of metal panel 302. Again, an access hole 318 was drilled through the layer of insulation 310 and the layers of sealer 312. The pilot hole 318 is sufficient to accommodate an extended socket 320. The extended socket 320 holds the head of the self-tapping screw 308. It is used to position the screw 308 and then to drive it through the metal panel 302 and into the beam 304. A clutched drill or other powered driver drives the socket 320.

The "blindly" method of the present invention can also be used for different purposes such as but not limited to: looking for beams to support roof-side equipment. When the beams are located and marked, the dimensions for fabrication of the equipment support can then be determined accurately prior to fabrication, then brought to the site for a quicker and more professional install. Additionally, if the location of the beams is known, then it is known exactly where not to install perforations in the roof such as drains, ducting, etc.

There might be several conditions for requiring this method such as but not limited to: customer preference that no one enter the area (i.e., Clean rooms, production areas), low height ceilings at the interior with a great distance 20+ feet to the underside of the roof, heavy fire protection materials that obscures the details of the roof structure, additional levels of structure between exterior deck and interior view, previous roof retrofit, insulated from underside obscuring view, and access obscured by equipment; ducting, pipes and similar mechanical equipment.

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such aim in any way. The specification and drawings are, accordingly, to be regarded in an illustrative rather than a restrictive sense.

We claim:

1. A method of locating a beam positioned below a metal roof deck comprising the steps of:

Identifying blindly, after installation of said metal roof deck formed by a plurality of rectangular, overlapping, corrugated panels covered with at least one layer of insulation or sealer and supported from below by a plurality of parallel beams, a first location where a first beam of said plurality of parallel beams meets a first valley in the corrugated panels; wherein the step of identifying blindly comprises drilling a linear pattern of holes through the metal roof deck to initially assess at least one of the deck type and the direction of the panel's flutes or ribs, wherein said holes are spaced apart at a first predetermined distance.

2. The method of claim 1, further comprising:

reducing said first predetermined distance to asses at least one of: the deck style, the width of flute, taper of sides, and the width of the top surface of the deck.

3. The method of claim 2, further comprising:

locating said first beam within predetermined boundaries.

4. The method of claim 3, wherein the step of locating the first beam comprises:

at least one of: thumping the roof along a pattern, and bouncing a roof area to watch for deflection patterns and slope changes that might identify the beam location.

5. The method of claim 3, further comprising:

performing a lineal pattern of fastener installation attempts until a first contact is made with the first beam.

6. The method of claim 5, further comprising:

determining the width of said first beam by installing a plurality of fasteners trying to miss the first beam by a distance, on both sides of the beam.

7. The method of claim 5, wherein said plurality of fasteners are installed in a lineal pattern and said distance is as close as possible to the first beam's lateral edge.

8. The method of claim 1, wherein said first predetermined distance is about 6" apart.

9. The method of claim 3, wherein said predetermined boundaries is defined by the distance between parallel beams being no less than about 32" and no more than about 8'.

10. A method of securing an installed metal roof deck comprising the method of locating a beam of claim 1.

11. The method of claim 10, further comprising:

drilling a first access hole through the at least one layer of insulation or sealer at the first location, wherein the first access hole does not extend through the corrugated panels; and positioning a first fastener through the first access hole and driving the first fastener through the corrugated panels and into the first beam.

12. The method of claim 11, further comprising:

identifying blindly a second location where a first beam meets a second valley in the corrugated panels;

drilling a second access hole through the at least one layer of insulation or sealer at the second location, wherein the second access hole does not extend through the corrugated panels; and positioning a second fastener through the second access hole and driving the second fastener through the corrugated panels and into the first beam.

13. The method of claim 12, further comprising:

positioning a template that extends from the first fastener to the second fastener, wherein the template includes regular marks to identify intersections between valleys in the corrugated panels and the first beam.

14. The method of claim 13, further comprising:

drilling additional access holes through the at least one layer of insulation or sealer at locations aligned with the regular marks on the template, wherein the additional access holes do not extend through the corrugated panels; and positioning additional fasteners through each of the additional access holes and driving the additional fasteners through the corrugated panels and into the first beam.

15. The method of claim 13, wherein in the step of positioning a template, the regular marks are spaced at an interval equal to a distance between valleys in the corrugated panels.

16. The method of claim 14, wherein the first and second fasteners comprise a self-tapping screw, the step of positioning additional fasteners through each of the additional access holes comprises placing a head of a self-tapping screw in an extended socket having a length sufficient to reach through the at least one layer of insulation or sealer, and secure fastener head at deck below.

17. The method of claim 14, wherein the step of driving the additional fasteners comprises driving self-tapping screws through the corrugated panels and into the first beam and automatically stopping before the self-tapping screws strip by releasing a clutch.

18. The method of claim 14, wherein the first and second fasteners comprise a self-tapping screw and a washer having a width greater than a head of said self-tapping screw is adhered to said self-tapping screw to position and hold the washer in place while the installation is accomplished.

19. The method of claim 12, further comprising:

filling at least one of: the first access hole and the second access hole by at least one of: driving a tapered rigid plug into the holes and applying a sealer into the holes.

* * * * *